United States Patent [19]

Oudenhoven

[11] Patent Number: 4,483,156

[45] Date of Patent: Nov. 20, 1984

[54] BI-DIRECTIONAL VARIABLE SUBCOOLER FOR HEAT PUMPS

[75] Inventor: Gary L. Oudenhoven, La Crosse, Wis.

[73] Assignee: The Trane Company, La Crosse, Wis.

[21] Appl. No.: 604,664

[22] Filed: Apr. 27, 1984

[51] Int. Cl.[3] ..... F25B 13/00

[52] U.S. Cl. ..... 62/324.1; 62/324.6

[58] Field of Search ..... 62/160, 324.1, 324.6, 62/324.7

[56] References Cited

U.S. PATENT DOCUMENTS

| | | | |
|---|---|---|---|
| 4,171,622 | 10/1979 | Yamaguchi et al. | 62/160 |
| 4,173,865 | 11/1979 | Sawyer | 62/324.1 |
| 4,262,493 | 4/1981 | Lackey et al. | 62/324.1 |
| 4,359,877 | 11/1982 | Coyne | 62/278 |

*Primary Examiner*—Lloyd L. King

*Attorney, Agent, or Firm*—Ronald M. Anderson; Carl M. Lewis

[57] ABSTRACT

A bi-directional flow auxiliary heat exchanger is disposed in proximity to the outdoor heat exchanger of a heat pump. The auxiliary fin and tube coil is active in both the heating and cooling modes to subcool refrigerant fluid flowing from the condenser. During operation of the heat pump system in the cooling mode, the entire auxiliary coil is used for subcooling; however, a portion of the subcooler is bypassed during heating mode operation to reduce the effective size of the subcooler. The bypassed portion of the auxiliary coil is used for storing excess refrigerant charge. This arrangement provides the system with the optimum amount of subcooling in each mode of operation, and adjusts the refrigerant charge for optimum performance in both the heating and cooling modes.

19 Claims, 4 Drawing Figures

| UNIT CAPACITY (TONS) | A TOTAL NO. OF TUBES IN OUT-DOOR HEAT EXCHANGER | B NO. OF TUBES USED FOR SUBCOOLING (COOL.MODE) | % (B/A) | C NO. OF TUBES USED FOR SUBCOOLING (HEAT. MODE) | D NO. OF TUBES USED TO STORE REFRIG. (HEAT. MODE) | % (C/B) |
|---|---|---|---|---|---|---|
| 5 | 84 | 6 | 7.1% | 2 | 4 | 33.3% |
| 7½ | 72 | 8 | 11.1% | 2 | 6 | 25% |
| 10 | 54 | 9 | 16.7% | 1 | 8 | 11.1% |
| 12½ | 63 | 9 | 14.3% | 1 | 8 | 11.1% |
| 15 | 72 | 9 | 12.5% | 1 | 8 | 11.1% |

BI-DIRECTIONAL VARIABLE SUBCOOLER FOR HEAT PUMPS

DESCRIPTION

BACKGROUND OF THE INVENTION

Technical Field

This invention pertains broadly to a heat pump having a subcooler, and more specifically to a variable capacity subcooler that operates in both the heating and cooling modes of a heat pump system.

Background Art

Heat pumps for temperature conditioning air in a space are well known in the prior art. A basic heat pump system is selectably operable to either heat or cool a space by reversing the direction of refrigerant flow in the system and interchanging the function of the indoor and outdoor heat exchangers. A typical heat pump thus includes: a refrigerant compressor; an indoor heat exchanger and an outdoor heat exchanger, one of which operates as a condenser and the other as an evaporator in each mode of operation; a valve for reversing the direction of refrigerant flow in the system; expansion means associated with each heat exchanger and operative only when that heat exchanger functions as an evaporator; refrigerant flow lines connecting each of the aforementioned elements; and, in some systems, an accumulator interposed in the refrigerant line upstream of the compressor suction.

It is further known that subcooling refrigerant in a vapor-compression refrigeration system can substantially increase the efficiency of the system. Subcooling means cooling refrigerant, at a constant pressure, to a temperature below its condensing temperature. An auxiliary heat exchanger disposed downstream of the condenser and referred to as a subcooler is typically provided for this purpose. Discrete outdoor subcoolers are sometimes used on a heat pump, but are usually bypassed during operation of those systems in the heating mode.

The heating and cooling modes of a heat pump system differ in their requirements for refrigerant charge needed for peak efficiency. At least one prior art heat pump design uses the bypassed subcooler to store excess refrigerant charge during heating mode operation, when the charge required for optimum performance is normally less than it is during operation in the cooling mode.

Examples of prior art heat pump systems employing subcoolers include U.S. Pat. No. 4,173,865 which discloses a subcooler associated with an outdoor coil, where the entire subcooler is bypassed and stores charge during heating, and U.S. Pat. No. 4,171,622 which includes a subcooler disposed beneath the outdoor heat exchanger, for use in both the heating and cooling modes of operation. During operation in the heating mode, the subcooler coil prevents ice from forming on the outdoor coil; during operation in the heating mode, it provides subcooling. The subcooler of U.S. Pat. No. 4,171,622 is of the same effective size during both heating and cooling, and therefore, does not provide the optimum required subcooling in both modes of operation.

It is therefore one of the principal objects of the present invention to provide a variable capacity bi-directional subcooler for heat pumps.

Another object of this invention is to provide optimal subcooling in both the heating and cooling modes, for a given heat pump system.

A further object of the present invention is to provide a subcooler for heat pumps which during heating mode operation can function to both subcool a refrigerant and to store excess refrigerant charge.

It is still another object of the present invention to provide a subcooler for heat pump systems in which the subcooler is disposed beneath the outdoor heat exchanger to aid in defrosting the heat exchanger and in minimizing frost formation while the outdoor heat exchanger functions as an evaporator.

Yet still another object is to minimize liquid flooding to the compressor during defrost cycle reversals.

These and other objects of the invention will be apparent from the following description of the preferred embodiments and the attached drawings.

SUMMARY OF THE INVENTION

The subject invention is used in a refrigerant heat pump system selectively operable in a heating or cooling mode. The system includes a refrigerant compressor, an indoor heat exchanger, an outdoor heat exchanger, a reversing valve operable to select the heating or the cooling mode by interchanging the function of the indoor and outdoor heat exchangers so that they operate as an evaporator or a condenser, and first and second expansion/check valve means associated with the indoor and outdoor heat exchangers, respectively. The expansion/check valve means are operative to restrict refrigerant flow in one direction while permitting it freely in the opposite direction.

An auxiliary heat exchanger is disposed in close proximity to the outdoor heat exchanger, and comprises a first and a second section joined in serial flow arrangement. One end of the first section 15 is connected in fluid communication with the first expansion/check valve means; the other end of the first section is connected to one end of the second section. The serially joined ends of the first and the second sections and the other end of the second section are separately connected to the second expansion/check valve means.

During operation of the heat pump system in the cooling mode, refrigerant is subcooled in both the first and the second sections of the auxiliary heat exchanger. However, during operation of the system in the heating mode, only the first section is operative to subcool refrigerant, while the second section stores excess refrigerant to optimize the level of refrigerant charge then active in the system.

In addition, heat from the auxiliary heat exchanger reduces the amount of frost and ice which might otherwise form on the outdoor heat exchanger when it functions as an evaporator in the heating mode. During operation of the system in a defrost mode, heat from the auxiliary heat exchanger aids in melting frost formed on the outdoor heat exchanger.

DESCRIPTION OF THE PREFERRED EMBODIMENTS

Figure 1:
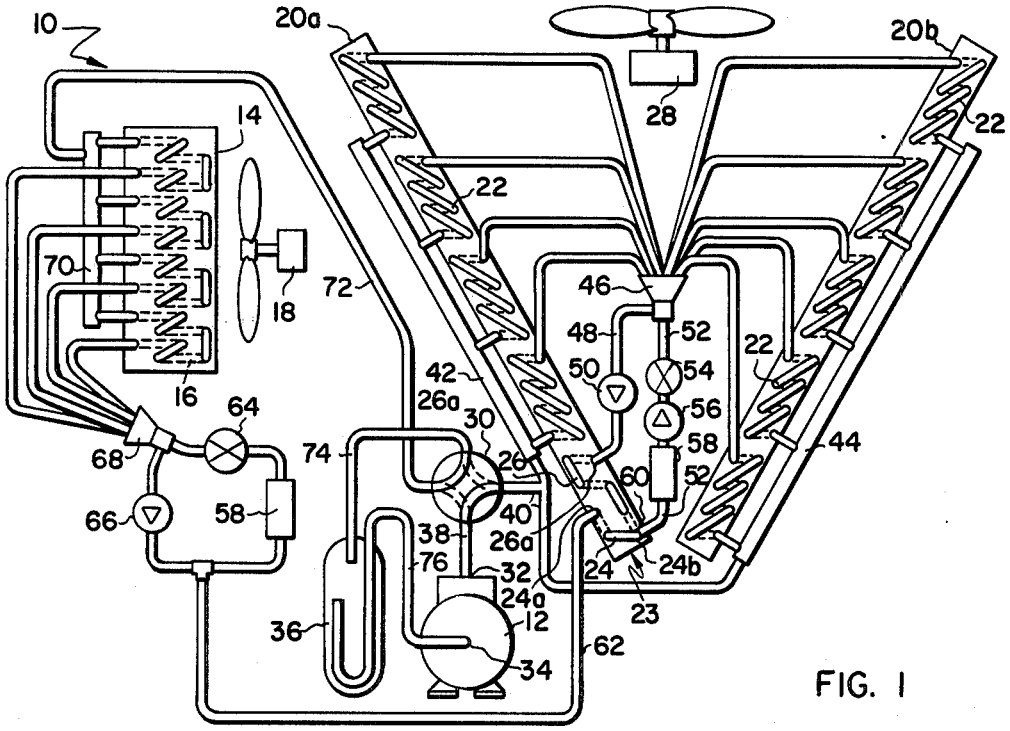
FIG. 1 shows a first embodiment of the subject invention in a heat pump system that includes two outdoor heat exchanger coils, where an auxiliary heat exchanger is associated with only one of two outdoor coils.

With reference to FIG. 1, a heat pump system incorporating the subject invention is generally denoted schematically by referrence numeral 10. Heat pump system 10 includes a refrigerant compressor 12, an indoor tube and fin heat exchanger 14 having a plurality of refrigerant tube circuits 16 and an indoor fan 18 that is operative to force air through the indoor heat exchanger 14 and into a comfort zone (not shown). Heat pump system 10 further includes an outdoor heat exchanger 20 comprising fin and tube coils 20*a* and 20*b*. Each of these coils include a plurality of two-row refrigerant tube circuits 22. Outdoor heat exchanger coils 20*a* and 20*b* are arranged in a "V" configuration, and are disposed in a housing (not shown) so that an outdoor fan 28 is operative to draw outdoor ambient air through the heat exchanger coils 20 in heat transfer relationship therewith.

A reversing valve 30 is provided for selectively connecting a discharge port 32 on compressor 12 either to the outdoor heat exchanger coils 20*a* and 20*b* in a cooling mode, or alternatively, to the indoor heat exchanger coil 14 in a heating mode. When reversing valve 30 is positioned to select the cooling mode, it connects the indoor heat exchanger 14 to a suction port 34 on compressor 12; and in the heating mode, connects the suction port 34 to the outdoor heat exchanger coils 20*a* and 20*b*. An accumulator 36 may be optionally interposed between the reversing valve 30 and suction port 34 to trap liquid refrigerant, thereby preventing "slugging" in compressor 12.

Outdoor heat exchanger coils 20*a* and 20*b* differ from one another in one significant respect. One of the refrigerant tube circuits 22 at the lower end of outdoor coil 20*a* is replaced by an auxiliary heat exchanger coil 23 that functions as a subcooler. Auxiliary heat exchanger 23 is also a fin and tube coil and comprises a first section 24 and a second section 26 connected in series flow arrangement. First section 24 extends between points 24*a* and 24*b*, and second section 26 extends between points 26*a* and 24*b*. The operation of subcooler 23 and the significance of the serial arrangement of the first section 24 and second section 26 is discussed hereinbelow.

As shown in FIG. 1, reversing valve 30 is positioned to supply compressed refrigerant through refrigerant lines 38 and 40 to outdoor refrigerant coil manifolds 42 and 44, for operation of system 10 in the cooling mode. Manifolds 42 and 44 distribute the hot refrigerant vapor to each of the refrigerant tube circuits 22 in coils 20*a* and 20*b*, respectively. Refrigerant vapor passing through coils 20*a* and 20*b* is condensed as it transfers heat to the outdoor ambient air, and is collected in a single manifold 46 disposed between the two coils. Manifold 46 has two refrigerant lines 48 and 52 connected to it in addition to the refrigerant tube circuits 22. In the cooling mode of operation, the condensed refrigerant flows through line 48 and through check valve 50 reaching the end of the second section of auxiliary coil 26, denoted by point 26*a*. The other refrigerant line 52 includes an expansion valve 54, a check valve 56, and a filter 58, and is connected at its other end to a "T" fitting 60 disposed on a "U" bend at point 24*b*, where the first section 24 is serially connected to the second section 26 of auxiliary coil 23.

During operation of heat pump system 10 in the cooling mode, condensed refrigerant cannot flow through refrigerant line 52 due to the orientation of check valve 56. As a consequence, condensed refrigerant flowing through line 48 passes through the entire auxiliary coil 23 and is thereby substantially subcooled before it enters refrigerant line 62 at point 24*a*.

Subcooled refrigerant liquid in line 62 flows through filter 58 and expansion valve 64 into circuit manifold 68. As the subcooled refrigerant passes through expansion valve 64 and into the indoor heat exchanger 14, it is vaporized by heat transfer with the air supplied to the comfort zone by indoor fan 18. Vaporized refrigerant exiting each of the refrigerant tube circuits 16 is collected by circuit manifold 70 and flows through refrigerant line 72 to reversing valve 30. The refrigerant vapor returns to the suction port 34 through refrigerant lines 74 and 76, after passing through accomulator 36 - if provided. If an accumulator is not required, refrigerant 74 is directly connected to the suction port.

During operation in the heating mode, refrigerant discharged from port 32 of compressor 12 is condensed in the indoor heat exchanger 14 by heat transfer with air supplied to the comfort zone by fan 18. The condensed refrigerant flows through check valve 66, bypassing expansion valve 64, and then through refrigerant line 62 to point 24*a*, at one end of the first section 24 of auxiliary heat exchanger coil 23. Refrigerant cannot flow out the second section 26 due to the orientation of check valve 50. This limits subcooling in this mode only to the first section 24. In the heating mode, substantially less subcooling is required than in the cooling mode. For this reason, the first section 24 comprises only a small percentage of the total number of tubes in the auxiliary coil. Subcooled refrigerant exits the first section 24 at point 24*b* through the "T" connection 60, and enters refrigerant line 52. It passes through the expansion valve 54 and is vaporized by heat transfer with outdoor ambient air passing through outdoor heat exchanger coils 20*a* and 20*b*.

In addition, as in most heat pump systems, efficient operation in the heating mode requires less refrigerant charge than in the cooling mode. Excess charge in the system 10 is stored in the second section 26 of auxiliary heat exchanger coil 23. Storing excess refrigerant charge in the second section 26 during the heating mode lowers the head pressure in the system, contributing to the overall efficiency of heat pump 10 by reducing the compressor power requirement. A lower system head pressure reduces compressor effeciency slightly, but this is more than offset by the reduced power requirement of compressor 12.

There is a further advantage in placing the auxiliary coil 23 in proximity to the outdoor heat exchanger coils 20*a* and 20*b* rather than indoors. The mass flow of the refrigerant through the indoor coil 14 which is acting strictly as a condenser is improved compared to the prior art designs in which the subcooler is placed in the indoor air stream. In addition, frost and ice buildup on the outdoor heat exchanger coil 20*a*, and to some extent coil 20*b*, which occurs during operation of heat pump system 10 in the heating mode when coils 20*a* and 20*b* function as evaporators is minimized by the disposition of the auxiliary heat exchanger 23 near the bottom of these coils. Normally, ice and frost buildup is greatest near the lower portion of an outdoor coil since water from ice melting from operation in the defrost mode tends to freeze as it runs down the coil face during operation in the heating mode. Heat from the auxiliary coil 23 minimizes this problem.

As implied above, frost and ice buildup on the outdoor coils 20*a* and 20*b* during operation of heat pump system 10 in the heating mode is melted by operating system 10 in a defrost mode. In defrost mode, refrigerant flow through the outdoor heat exchanger coils 20*a* and 20*b* and auxiliary heat exchanger coil 23 is substantially the same as during operation of the system in the cooling mode. The close proximity of the auxiliary heat exchanger coil 23 to the outdoor heat exchanger coils, particularly coil 20*a*, provides additional heat during the defrost mode. This improves the efficiency of the defrost cycle.

In conventional heat pump systems, an accumulator 36 is generally required so that upon changeover from the heating mode to the defrost mode, the refrigerant flow reversal does not flood the compressor 12 with liquid refrigerant present in the indoor heat exchanger coil. Accumulator 36 may not be required in heat pump system 10 for two reasons:

(a) during operation in the heating mode, liquid refrigerant is present in the refrigerant line 62 and in auxiliary coil 23, but very little is in the indoor heat exchanger 14; on changeover to defrost, virtually all this liquid is vaporized as it passes through expansion valve 64; and (b) on changeover from the defrost to heating mode, virtually all the liquid refrigerant in the system is again accumulated in line 62 and auxiliary coil 23, and this liquid is vaporized as it passes through expansion valve 54.

In both cases, the liquid refrigerant is substantially vaporized before reaching the compressor 12, preventing damage due to "slugging" by liquid refrigerant entering suction port 34.

The number of tubes through the auxiliary heat exchanger coil 23 which are active in both the heating and cooling modes is selected so that refrigerant leaving the auxiliary heat exchanger coil 23 is subcooled only the required amount below the liquid point. Since both the auxiliary coil 23 and the outdoor heat exchanger 20 are subject to relatively cold outdoor ambient temperatures during operation in the heating mode, much less subcooling is required. Providing the proper amount of subcooling capacity in both heating and cooling modes improves the heat pump system efficiency, compared to prior art systems in which either too little or too much subcooling is provided.

As shown in the first preferred embodiment FIG. 1 (and in those that follow) the first section 24 is disposed generally lower in elevation than the second section 26. This is done to insure that any lubricating oil carried with refrigerant fluid into the second section 26 during operation of heat pump system 10 in the cooling mode is not trapped therein during subsequent operation in the heating mode. Instead, such oil will run down into the lower first section 24, where it is carried away with refrigerant fluid, and eventually returned to the compressor 12. Assuming that oil trapping is not a problem, the relative positions of the first and second sections 24 and 26 may be interchanged.

Figure 2:
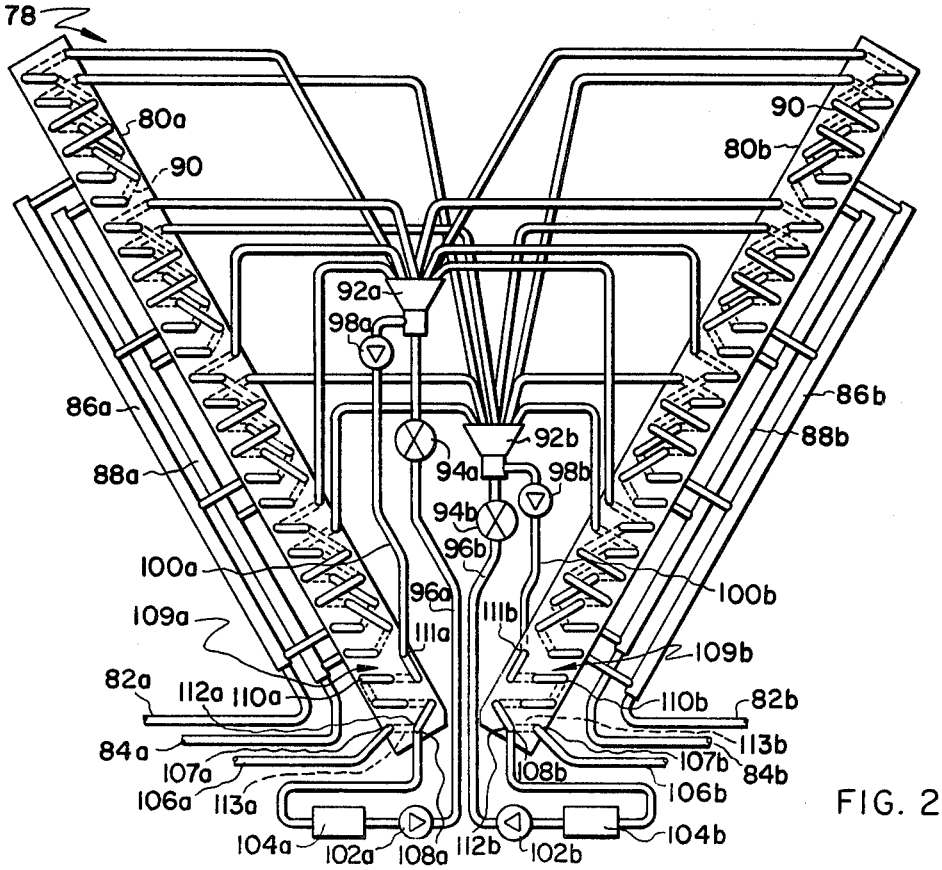
FIG. 2 shows a second embodiment of the invention, where the outdoor heat exchanger has two three-row coils, each having an associated auxiliary heat exchanger.

Turning now to FIG. 2, an alternative outdoor heat exchanger 78 is shown that includes a second embodiment of the subject invention. The outdoor heat exchanger 78 comprises similar three-row heat exchanger coils 80*a* and 80*b* in a "V" configuration, each including a plurality of intertwined refrigerant tubing circuits 90. It will be understood that outdoor heat exchanger 78 is part of a heat pump system operating generally in the same manner as explained for system 10 hereinabove.

The construction and operation of the outdoor heat exchanger coils 80*a* and 80*b* are generally identical; therefore, in the following discussion, reference numerals without the "a" and "b" notation are used to describe the construction and function of the common elements associated with both heat exchanger coils. In the cooling mode of its associated heat pump system, refrigerant enters the outdoor heat exchanger coils 80 through refrigerant lines 82 and 84 either from separate compressors or compressor stages (not shown) each similar to compressor 12 of FIG. 1. Refrigerant flowing in lines 82 is distributed to each of the tubing circuits 90 by manifolds 86. Likewise, refrigerant in lines 84 is distributed to these circuits 90 through manifolds 88.

Refrigerant condensed in outdoor heat exchanger coils 80 is collected in circuit manifolds 92, and flows through refrigerant lines 100 and check valves 98 into the auxiliary fin and tube heat exchanger coils 109. Refrigerant enters these coils at points 111, flows through the second sections 110 that are joined in serial flow relationship to the first sections 113, and exits therefrom at points 108 into refrigerant lines 106. The second sections 110 of the auxiliary heat exchanger coils 109 thus extend from points 111 to points 108, and the first sections from points 107 to points 108. In the embodiment shown in FIG. 2, the first sections 113 include two tube passes, whereas the second sections 110 have 6 tube passes.

Also connected to circuit manifolds 92 are refrigerant lines 96 that include expansion valves 94, check valves 102, and filters 104. The other ends of refrigerant lines 96 terminate at "T" fittings 112 disposed in "U" bends at points 108.

During operation in the heating mode, refrigerant flow through outdoor coils 80 is reversed. Condensed refrigerant flows through lines 106, through the first sections 113 of auxiliary heat exchanger coils 109, out "T" fittings 112 and into refrigerant lines 96. The subcooled refrigerant expands by heat transfer with outdoor ambient air after passing through expansion valves 94. Check valves 98 prevent the flow of refrigerant through the second sections 110 of auxiliary heat exchanger coils 109, and the second sections are thus used to store excess refrigerant charge, with the benefits explained hereinabove. The advantages of the subject invention in reducing the buildup of frost and ice at the bottom of the outdoor heat exchanger coil and the improved efficiency of the deforst cycle is fully realized by each of the outdoor exchanger coils 80*a* and 80*b*, since each is provided with the auxiliary heat exchanger coil 109.

Figures 3, 4:
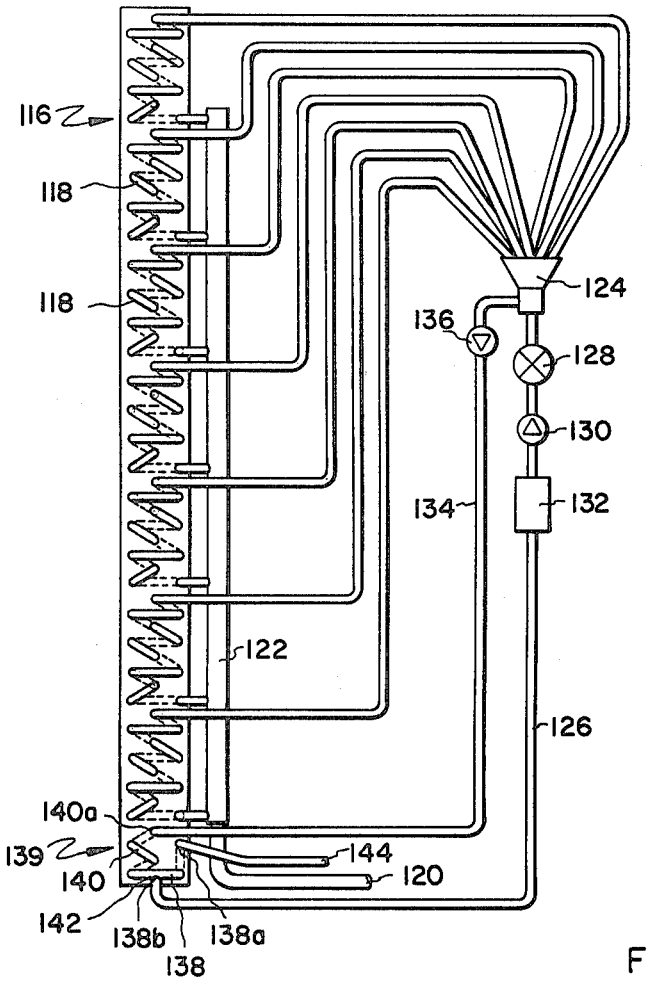
FIG. 3 shows a third embodiment of the invention, where the outdoor heat exchanger is configured in a single three-row coil.
FIG. 4 is a table showing for various size heat pump systems: the total number of heat exchanger tubes in the outdoor heat exchanger; the number of tubes used for subcooling during operation in both the cooling and the heating mode, and the number of tubes used to store refrigerant in the heating mode.

A third embodiment of an outdoor fin and tube heat exchanger incorporating the subject invention is shown in FIG. 3, generally denoted by reference numeral 116. Outdoor heat exchanger 116 includes a plurality of three-row tube circuits 118 supplied with compressed refrigerant during operation of the heat pump system in the cooling mode, by means of refrigerant line 120 and circuit manifold 122. It will be understood that outdoor heat exchanger 116 is used in a heat exchanger system similar to that shown in FIG. 1, and the compressed refrigerant is supplied from the system as previously explained for the first embodiment. While operating in the cooling mode, the outdoor heat exchanger 116 functions as a condenser. Condensed refrigerant from tube circuits 118 is collected by circuit manifold 124 and flows through refrigerant line 134 to the end of an auxiliary fin and tube heat exchanger coil 139. Auxiliary coil 139 comprises a first section 138 that extends between points 138*a* and 138*b*, and a second section 140 extending between points 140*a* and 138*b* in serial flow relationship with the first section 138. Refrigerant from line 134 is thus subcooled as it flows through both the second section 140 and first section 138, and out through refrigerant line 144.

During operation of the associated heat pump system in the heating mode, refrigerant flow through the outdoor heat exchanger 116 is in the reverse direction such that condensed refrigerant flows from line 144 into the first section 138 of the auxiliary coil 139 at point 138*a*, and exits through a "T" connection 142 disposed in a "U" bend at point 138*b*. Only the first section 138 comprising two tube passes is operative as a subcooler in this mode, and the condensed and subcooled refrigerant flows through refrigerant line 126, passing through filter 132, check valve 130, and expansion valve 128. Refrigerant vaporizes in outdoor heat exchanger 116 as it expands in heat transfer relationship with the outdoor ambient air. The vaporized refrigerant is collected in manifold 122 and flows back through refrigerant line 120. Excess refrigerant charge is again stored in the second section 140.

The various benefits previously described for the subject invention as applied to the first two embodiments disclosed are also applicable to the third embodiment. These include the improvement in operating efficiency of the heat pump system, the optimization of the refrigerant charge in the system in each of the heating and cooling modes of operation, and the improvements in defrost,—with regard to minimizing the need for defrost and improving the efficiency of the defrost cycle and in preventing "slugging" by liquid refrigerant when entering and leaving the defrost mode.

FIG. 4 shows the relationship of the total number of tubes used in the outdoor heat exchanger coil and the number of tubes active in both the heating and cooling modes for several heat pump systems ranging in size from 5 to 15 tons rated capacity. The embodiment shown in FIG. 1 corresponds to a 7½ ton heat pump system, and the embodiment in FIGS. 2 and 3 to a 15 ton and 5 ton system, respectively. From the data shown in FIG. 4, it should be clear that the percentage of tubes used for subcooling relative to the total number of tubes in the outdoor heat exchanger, and the percentage of the tubes used for subcooling in the heating mode as compared to the total number of tubes in the subcooler depends both upon the size and upon the design of the heat pump system. In each case, the number of tubes functioning as a subcooler during the heating mode is substantially less than those functioning during the cooling mode.

While the present invention has been described with respect to several embodiments involving various configurations for an outdoor heat exchanger, it is to be understood that modifications thereto will become apparent to those skilled in the art, which modificaions lie within the scope of the present invention, as defined in the claims that follow.

I claim:

1. In a refrigerant heat pump system selectively operable in a heating or cooling mode, said system including a refrigerant compressor, an indoor heat exchanger, an outdoor heat exchanger, a reversing valve operable to select the heating or the cooling mode by interchanging the operating function of the indoor and the outdoor heat exchangers as an evaporator and a condenser, and first and second expansion/check valve means associated with the indoor and outdoor heat exchangers respectively, and operative to restrict refrigerant flow in one direction while allowing it in another direction, an auxiliary heat exchanger disposed with the outdoor heat exchanger, said auxiliary heat exchanger comprising:

a first and a second section joined in serial flow arrangement, with one end of the first section being connected in fluid communication with the first expansion/check valve means, and the other end of the first section connected to one end of the second section, the serially joined end of the first and second section and the other end of the second section being connected separately to the second expansion/check valve means, said auxiliary heat exchanger being operative to subcool refrigerant fluid leaving the outdoor heat exchanger during operation of the system in the cooling mode using both the first and second sections, and operative to subcool refrigerant flowing through the second expansion/check valve means and into the outdoor heat exchanger using the first section while storing excess refrigerant in the second section during operation of the system in the heating mode.

2. The heat pump system of claim 1 wherein the second expansion/check valve means include a first check valve connected in parallel refrigerant flow relationship with means for restricting flow into the outdoor heat exchanger, said first check valve being connected to allow refrigerant fluid to flow freely from the outdoor heat exchanger into said other end of the second section.

3. The heat pump system of claim 2 wherein the flow restricting means include a second check valve oriented to allow refrigerant fluid to flow into the outdoor heat exchanger and to block refrigerant fluid from flowing out of the outdoor heat exchanger through the flow restricting means, and wherein the flow restricting means is connected in fluid communication between the serially joined end of the first and second section and the outdoor heat exchanger.

4. The heat pump system of claim 3 wherein the flow restricting means include an expansion valve.

5. The heat pump system of claim 1 wherein both the outdoor heat exchanger and the auxiliary heat exchanger are tube and fin coils and the auxiliary heat exchanger is disposed adjacent the outdoor heat exchanger and generally below it in elevation.

6. The heat pump system of claim 5 wherein the first section includes substantially fewer tubes than the second section.

7. The heat pump system of claim 1 wherein the first section of the auxiliary heat exchanger is disposed generally lower in elevation than the second section.

8. In a heat pump system for selectively heating or cooling a space, said system including a refrigerant compressor having a discharge port and a suction port; an indoor heat exchanger; an outdoor heat exchanger; a reversing valve in fluid communication with both the indoor and outdoor heat exchangers and the suction and discharge ports and operative to selectively connect the discharge port in fluid communication with the indoor heat exchanger and the suction port in fluid communication with the outdoor heat exchanger in a heating mode, and operative to selectively connect the discharge port in fluid communication with the outdoor heat exchanger and the suction port in fluid communication with the indoor heat exchanger in a cooling mode; first expansion/check valve means for restricting the flow of refrigerant into the indoor heat exchanger in the cooling mode and allowing refrigerant to flow freely out of the indoor heat exchanger in the heating mode; second expansion/check valve means having a first flow path connected in parallel to a second flow path, for restricting refrigerant fluid flow into the outdoor heat exchanger through the first flow path in the heating mode and for allowing refrigerant fluid to flow freely out of the outdoor heat exchanger through the second flow path in the cooling mode; and a refrigerant line connecting the first expansion/check valve means in fluid communication with an auxiliary heat exchanger disposed in proximity to the outdoor heat exchanger, said auxiliary heat exchanger comprising a first section and a second section, one end of the first 25 section connected to the refrigerant line and the other end joined with a "T" connection in series flow relationship to one end of the second section the other end of the second section being connected to the second flow path of the second expansion/check valve means, said "T" connection being connected to the first flow path;

whereby in the cooling mode, condensed refrigerant fluid flows from the outdoor heat exchanger through the second flow path and is subcooled as it flows through both sections of the auxiliary heat exchanger; and whereby in the heating mode, condensed refrigerant fluid flows from the indoor heat exchanger through the refrigerant line and is subcooled as it flows through the first section and into the first flow path, while the second section of the auxiliary heat exchanger is operative to store excess refrigerant charge.

9. The heat pump system of claim 8 wherein the second expansion/check valve means include a first check valve in the second flow path that is operative to block refrigerant fluid flow into the outdoor heat exchanger from the second section while permitting fluid flow in the reverse direction, and further include in said first flow path, means for restricting refrigerant flow into the outdoor heat exchanger, connected in series flow relationship with a second check valve that is operative to block refrigerant fluid flow into the "T" connection from the outdoor heat exchanger while permitting fluid flow in the reverse direction.

10. The heat pump system of claim 9 wherein the flow restricting means include an expansion valve.

11. The heat pump system of claim 8 wherein both the outdoor heat exchanger and the auxiliary heat exchanger are fin and tube coils and the auxiliary heat exchanger is disposed adjacent the outdoor heat exchanger, and generally below it in elevation.

12. The heat pump system of claim 11 wherein the first section includes substantially fewer tubes than the second section.

13. The heat pump system of claim 11 wherein the fin and tube coil of the auxiliary heat exchanger includes a plurality of "U" bends connecting the tubes in a circuit and wherein said "T" connection is disposed on one of the "U" bends to avoid trapping oil that might be entrained in the refrigerant.

14. The heat pump system of claim 8 wherein the first section of the auxiliary heat exchanger is disposed generally lower in elevation than the second section.

15. In a refrigerant heat pump system selectably operable in a heating or a cooling mode, said system including an outdoor heat exchanger, an expansion/check valve means for controlling refrigerant flow into and out of the outdoor heat exchanger, and an auxiliary heat exchanger including a first and a second section disposed in proximity to the outdoor heat exchanger, a method for subcooling refrigerant comprising the steps of:

subcooling the refrigerant leaving the outdoor heat exchanger using both the first and second sections of the auxiliary heat exchanger during operation of the system in the cooling mode; and subcooling refrigerant flowing through the expansion/check valve means into the outdoor heat exchanger using only the first section while storing excess refrigerant in the section of the auxiliary heat exchanger, during operation of the system in the heating mode.

16. The method of claim 15 wherein both the outdoor heat exchanger and the auxiliary heat exchanger are fin and tube coils and wherein the auxiliary heat exchanger is substantially lower in elevation than the outdoor heat exchanger and generally in heat transfer relationship therewith.

17. The method of claim 16 further comprising the step of melting the ice and frost on an adjacent portion of the outdoor heat exchanger by heat transfer from the auxiliary heat exchanger as refrigerant flows from the outdoor heat exchanger through both the first and the second sections of the auxiliary heat exchanger during operation of the system in a defrost mode.

18. The method of claim 17 further comprising the step of vaporizing liquid refrigerant as it passes from the first and second sections of the auxiliary heat exchanger, through the expansion/check valve means, and into outdoor heat exchanger, upon changeover from the defrost mode to the heating mode, thereby preventing "slugging" in the heat pump system.

19. The method of claim 16 wherein the first section of the auxiliary heat exchanger is substantially lower in elevation and has substantially fewer tubes than the second section.

* * * * *